US012345421B2

(12) United States Patent
Berling

(10) Patent No.: US 12,345,421 B2
(45) Date of Patent: Jul. 1, 2025

(54) DEVICE FOR EXTRACTING VAPOURS AND METHOD FOR EXTRACTING VAPOURS BY MEANS OF THE DEVICE AND USE OF THE DEVICE FOR EXTRACTING VAPOURS

(71) Applicant: CASO HOLDING GMBH, Arnsberg (DE)

(72) Inventor: Udo Berling, Schapen (DE)

(73) Assignee: Caso Holding GmbH, Arnsberg (DE)

( * ) Notice: Subject to any disclaimer, the term of this patent is extended or adjusted under 35 U.S.C. 154(b) by 495 days.

(21) Appl. No.: 17/623,052

(22) PCT Filed: Jun. 24, 2020

(86) PCT No.: PCT/EP2020/067605
§ 371 (c)(1),
(2) Date: Dec. 27, 2021

(87) PCT Pub. No.: WO2020/260344
PCT Pub. Date: Dec. 30, 2020

(65) Prior Publication Data

US 2022/0252275 A1 Aug. 11, 2022

(30) Foreign Application Priority Data

Jun. 26, 2019 (DE) ..... 102019117148.2

(51) Int. Cl.
*F24C 15/20* (2006.01)
*F24F 7/007* (2006.01)

(52) U.S. Cl.
CPC ..... *F24C 15/20* (2013.01); *F24F 7/007* (2013.01)

(58) Field of Classification Search
CPC ..... F24C 15/20; F24C 15/2042; F24F 7/007; F24F 7/013
(Continued)

(56) References Cited

U.S. PATENT DOCUMENTS 356,722 A * 1/1887 Lindley ..... F24C 15/2042 126/300
603,730 A * 5/1898 Keller ..... F24C 15/2042 126/300
(Continued)

FOREIGN PATENT DOCUMENTS

CN 2240866 Y * 11/1996
CN 108209711 A * 6/2018
(Continued)

OTHER PUBLICATIONS

International Search Report and Written opinion dated Oct. 19, 2020 pertaining to PCT Application No. PCT/EP2020/067605 filed Jun. 24, 2020.
(Continued)

*Primary Examiner* — Jorge A Pereiro
(74) *Attorney, Agent, or Firm* — Dinsmore & Shohl LLP

(57) ABSTRACT

A device for extracting vapors comprising an intake housing and a blower, wherein the intake housing comprises an air inlet means, wherein the air inlet means has an upper wall and a lower wall which form an interior space with an inlet opening, wherein at least the upper wall has a corrugated shape on an inner side with at least two upwardly curved surface sections, wherein at least in the region of the upwardly curved surface sections the interior space has widenings.

14 Claims, 6 Drawing Sheets

(58) Field of Classification Search
USPC ..... 126/299 D
See application file for complete search history.

(56) References Cited

U.S. PATENT DOCUMENTS

| | | | | | |
|---|---|---|---|---|---|
| 1,128,085 | A * | 2/1915 | Williams | F23L 17/10 | 454/22 |
| 1,526,340 | A * | 2/1925 | Hjorth | F24C 15/2042 | 126/300 |
| 2,785,849 | A * | 3/1957 | Stalker | F04D 19/028 | 415/209.1 |
| 2,796,214 | A * | 6/1957 | Stalker | F04D 19/028 | 415/209.1 |
| 3,165,123 | A * | 1/1965 | Hawkins | F15D 1/065 | 114/67 R |
| 3,643,702 | A * | 2/1972 | Kauder | F15D 1/065 | 138/121 |
| 3,952,640 | A * | 4/1976 | Kuechler | F24C 15/20 | 55/DIG. 36 |
| 4,406,433 | A * | 9/1983 | Radkey | B64D 17/025 | 244/145 |
| 5,036,906 | A * | 8/1991 | Rylewski | F24F 12/006 | 165/909 |
| 5,597,985 | A * | 1/1997 | Dear | F24F 13/24 | 181/227 |
| 6,138,781 | A * | 10/2000 | Hakala | F03D 9/25 | 180/2.2 |
| 6,685,256 | B1 * | 2/2004 | Shermer | B62D 35/001 | 296/180.1 |
| 10,801,735 | B2 * | 10/2020 | Sinur | F24C 15/2042 | |
| 2002/0083943 | A1 * | 7/2002 | Chang | F24C 15/20 | 126/299 R |
| 2002/0182060 | A1 * | 12/2002 | Chou | F04D 29/703 | 415/121.2 |
| 2004/0103789 | A1 * | 6/2004 | Lan | B01D 46/10 | 55/490.1 |
| 2006/0096257 | A1 * | 5/2006 | Berling | F24C 15/20 | 55/320 |
| 2010/0051010 | A1 * | 3/2010 | Colburn | F24C 15/2028 | 126/299 D |
| 2010/0081367 | A1 * | 4/2010 | Tran | B08B 15/00 | 454/49 |
| 2012/0132479 | A1 * | 5/2012 | Dittmar | F04D 29/701 | 181/225 |
| 2014/0034039 | A1 * | 2/2014 | Qi | F24F 1/01 | 137/565.22 |
| 2015/0184806 | A1 * | 7/2015 | Beg | E21B 41/0071 | 138/40 |
| 2015/0337878 | A1 * | 11/2015 | Schlosser | F41A 21/30 | 181/227 |
| 2016/0209049 | A1 * | 7/2016 | Limberg | F24C 15/2042 | |
| 2017/0227029 | A1 * | 8/2017 | Ito | F16L 55/02709 | |
| 2019/0015861 | A1 * | 1/2019 | Mariani | E04H 15/44 | |

FOREIGN PATENT DOCUMENTS

| | | | | | |
|---|---|---|---|---|---|
| CN | 208502821 | U | | 2/2019 | |
| CN | 208854318 | U | * | 5/2019 | |
| DE | 3505401 | A1 | * | 8/1986 | |
| DE | 4233312 | A1 | * | 4/1994 | F04D 29/664 |
| DE | 1624254 | A1 | | 3/2003 | |
| DE | 20218265 | U1 | | 3/2003 | |
| DE | 10255317 | A1 | | 6/2004 | |
| DE | 10314410 | A1 | | 10/2004 | |
| DE | 202005017821 | U1 | * | 2/2006 | F16L 43/00 |
| DE | 102009028808 | A1 | | 2/2011 | |
| DE | 102015202655 | A1 | * | 8/2015 | B60H 1/00564 |
| EP | 1955630 | A2 | * | 8/2008 | A47L 5/22 |
| EP | 2708128 | A2 | * | 3/2014 | A21B 3/04 |
| EP | 3220060 | A1 | | 9/2017 | |
| KR | 20190001543 | U | * | 6/2019 | |
| WO | WO-2018050719 | A1 | * | 3/2018 | B01D 45/14 |

OTHER PUBLICATIONS

First Office Action issued on Jun. 28, 2024 in related Chinese Patent Application No. 202080045997.6.

* cited by examiner

DEVICE FOR EXTRACTING VAPOURS AND METHOD FOR EXTRACTING VAPOURS BY MEANS OF THE DEVICE AND USE OF THE DEVICE FOR EXTRACTING VAPOURS

CROSS-REFERENCE TO RELATED APPLICATIONS

This application is the U.S. national stage of PCT/EP2020/067605 filed Jun. 24, 2020, which claims priority of German patent application 102019117148.2 filed Jun. 26, 2019, both of which are hereby incorporated by reference in their entirety.

FIELD OF THE INVENTION

The invention relates to a device for extracting vapors comprising an intake housing and a blower, as well as a method for extracting vapors over a cooking hob by means of the device and a use of the device for extracting vapors over a cooking hob.

BACKGROUND OF THE INVENTION

Devices for extracting fumes are well known and are usually designed as extractor hoods. For example, DE 10 2017 131 168 A1 describes an extractor hood with an extraction blower held in a frame, an intake opening, an air guide duct between the intake opening and the extraction blower, and a guide surface arranged at an angle to the horizontal above a hob, in which the intake opening is formed.

DE 103 14 410 A1 discloses an extractor hood with a housing having a slot-shaped air inlet, the housing having a curved upper housing edge section and a housing section directed towards a cleaning flap on the bottom side of the housing.

DE 10 2009 028 808 A1 discloses an extractor hood with an inner frame and a viewing hood that is designed to be detachable from a base frame.

EP 3 220 060 A1 discloses a vapor extraction device in which a blower housing is rotatably mounted on the vapor extraction housing by means of elongated holes.

DE 202 18 265 U1 discloses a combined extractor hood and cleaning hood.

The disadvantage of prior art extractor hoods is that they are mounted in a fixed location, in particular directly above the hob, to collect the rising vapors. For example, in cookshops, mobile kitchens and food trucks, and in cooking areas that do not have a wall or ceiling on which such extractor hoods can be mounted, vapors cannot be extracted. In addition, permanently installed vapor extraction devices do not offer the possibility of mobility or cannot be used flexibly at different cooking facilities.

It is the object of the present invention to provide a device for extracting vapors which avoids the disadvantages known from the prior art. In particular, it is the task of the invention to provide a mobile device for the extraction of vapors.

SUMMARY OF THE INVENTION

The object is solved according to the invention by means of a device for extracting vapors comprising an intake housing and a blower, in particular arranged in a blower housing, the intake housing comprising an air inlet means, the air inlet means having an upper wall and a lower wall which form an interior with an inlet opening and wherein the air inlet means has a horizontal opening angle, wherein the horizontal opening angle is an angle in a horizontal sectional view of the air inlet means, the sides of which are applied to the lateral inner walls, at least the upper wall having on an inner side a corrugated shape with at least two upwardly curved surface sections, the interior having widenings at least in the region of the upwardly curved surface sections.

Alternatively or supplementarily, the object is solved according to the invention by means of a device for extracting vapors comprising an intake housing and a blower, in particular arranged in a blower housing, wherein the intake housing comprises an air inlet means, wherein the air inlet means has an upper wall and a lower wall which form an inlet opening, wherein a projection is associated with the inlet opening.

Alternatively or supplementarily, the object is solved according to the invention by means of an intake housing comprising an air inlet means, the air inlet means having an upper wall and a lower wall forming an inlet opening, the inlet opening being associated with a projection.

Furthermore, the object is solved according to the invention by means of a method for extracting vapors above a cooking hob by means of the device, wherein an air flow is generated by means of a blower into an intake housing with an air inlet means, wherein the air inlet means has a horizontal opening angle, at least by means of an upper wall of the air inlet means, which has a corrugated shape with at least two upwardly curved surface sections at least on an inner side, the air flow is at least partially applied to at least the upper wall, the air flow is directed at least via an outflow opening of the air inlet means, for example formed in a lower wall, into a blower, which is arranged in particular in a blower housing.

Alternatively or supplementarily, the task is solved according to the invention by means of a method for extracting vapors above a cooking hob by means of the device, wherein an air flow is generated by means of a blower into an intake housing with an air inlet means, the air flow in front of an air inlet means is calmed and/or directed by means of a projection extending in particular over an inlet opening of the intake housing, the air flow is drawn into the intake housing through the inlet opening and the air flow is directed at least via an outflow opening of the air inlet means, for example formed in a lower wall, into a blower, which is arranged in particular in a blower housing.

Furthermore, the object is solved according to the invention by means of using the device for extracting vapors above a cooking hob.

BRIEF DESCRIPTION OF THE DRAWINGS

Further advantageous embodiments are shown in the following drawings. However, the further embodiments shown there are not to be interpreted restrictively; rather, the features described there can be combined with one another with the features described above for further embodiments. Furthermore, it should be noted that the reference numbers given in the figure description do not limit the scope of protection of the present invention, but merely refer to the examples of embodiments shown in the figures. Identical parts or parts having the same function have the same reference signs in the following. The following are shown.

DETAILED DESCRIPTION

Figure 1:
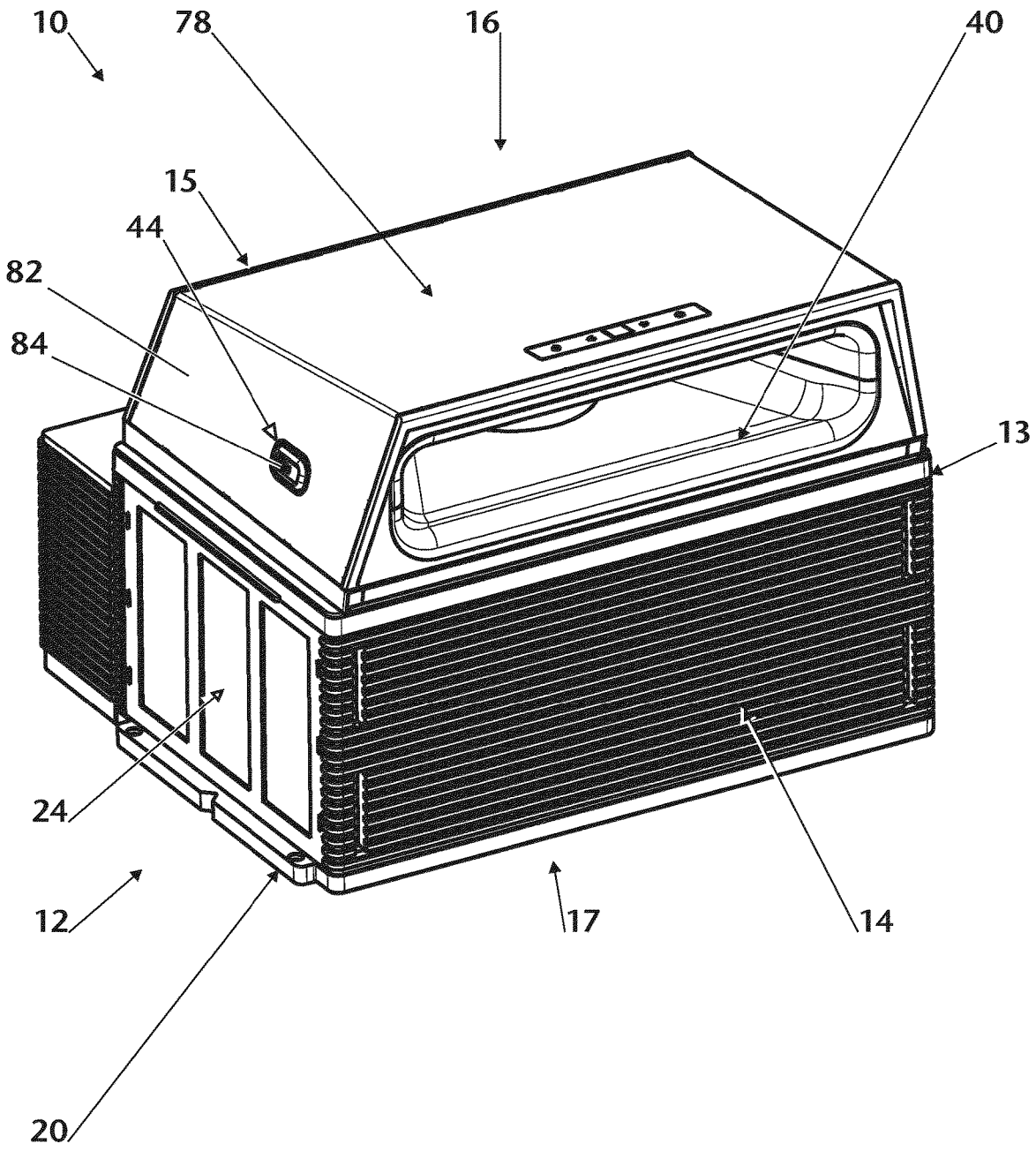
FIG. 1 a device for the extraction of vapors.

The alternative solutions according to the invention solve the object of the invention individually or in combination with each other.

In one embodiment, the device is provided with at least one upper wall having a corrugated shape and having no projection. In one embodiment, the device does not have an upper wall with a corrugated shape, but does have a projection. In one embodiment, the device includes at least one upper wall having a corrugation and a projection.

In one embodiment of the method, it is provided that at least by means of an upper wall of the air inlet means, which has a corrugated shape at least on an inner side, the air flow is at least partially applied to at least the upper wall, but the air flow is not calmed and/or directed in front of an air inlet means by means of a projection extending in particular over an inlet opening of the intake housing. In one embodiment of the method, it is provided that the air flow is not at least partially applied to at least the upper wall of the air intake means by means of an upper wall of the air intake means, which has a corrugated shape at least on an inner side, but that the air flow is calmed and/or directed in front of an air intake means by means of a projection extending in particular over an inlet opening of the intake housing. In one embodiment of the method, it is provided that at least by means of an upper wall of the air inlet means, which has a corrugated shape at least on an inner side, the air flow is at least partially applied to at least the upper wall and, in addition, by means of a projection extending in particular over an inlet opening of the intake housing, the air flow is calmed and/or directed in front of an air inlet means.

In particular, the proposed device is mobile, i.e. movable and freely positionable. Another advantage is that the device does not necessarily have to be arranged above a hob, but can be arranged next to a hob and still draw sufficient vapors into the device and, in particular, filter or dry them there. The device according to the invention can be used flexibly, especially in places where there is usually little or no technical kitchen equipment, such as cookshops or food trucks, or in private or commercial kitchens where technical, financial and/or building equipment does not permit the installation of extractor hoods. In particular, it is possible to use the device on different cooking opportunities such as a gas burner, a grill, an electric cooktop, and/or other cooking opportunities.

In particular, it is provided that the intake housing and the blower housing are movable together and/or separately. In particular, the weight is such that the blower housing and/or the intake housing are easily portable, in particular a weight of less than about 25 kg more preferably less than about 10 kg, more preferably between about 3 kg and about 10 kg, more preferably less than about 3 kg, more preferably less than about 1 kg is provided for the device or for parts of the device. In particular, the intake housing weighs less than about 1 kg.

If, in the context of the invention, the term "about" is used in connection with values or ranges of values, this is to be understood as a range of tolerance which the person skilled in the art considers to be usual in this field, in particular a range of tolerance of ±20%, preferably ±10%, further preferably ±5% is provided.

In one embodiment, it is provided that the device is placeable on a movable and/or rollable base, for example, a tea cart, a serving cart, and/or a vehicle configured for the device.

In particular, the device can be used both indoors and outdoors.

In particular, the device has a top surface and a bottom surface and two sides, a front and a rear. Preferably, the blower housing is associated with the bottom surface and the intake housing with the top surface. In a further embodiment, it is provided that the blower housing is associated with the top surface and the intake housing is associated with the bottom surface. In the further description, it is assumed that the intake housing is arranged above the blower housing. However, a reverse embodiment may be provided in each case.

In a further embodiment, it is provided that the intake housing has an operating element by means of which the device can be operated. The operating element preferably has at least one touch sensor and/or at least one button and/or at least one switch. In particular, an air flow into the device can be controlled by means of the operating element. For example, at least one intensity of a blower arranged in the blower housing can be regulated or controlled by means of the operating element.

Further preferably, the intake housing has a cover. Preferably, the cover is associated with at least the top surface, more preferably the sides, more preferably the rear of the intake housing. In one embodiment, the cover forms the projection. The projection is associated in particular with the front of the intake housing, which in particular has the inlet opening. In one embodiment, it is provided that the projection is associated with the inlet opening.

An advantage of the projection is that the incoming air is calmed before flowing through the inlet opening into the intake housing. Another advantage of the projection is that the intake air flow is directed. In particular, a direction of airflow can be generated substantially from below and from the front by the projection. It is further advantageously provided that the projection substantially prevents an air flow from above into the inlet opening. This results in an air flow into the inlet opening that is guided either straight into the device or into the intake housing or from below into the intake housing.

The term "substantially" indicates a range of tolerance which is justifiable for the person skilled in the art in the field of extractor devices for cooking vapors from an economic and technical point of view, so that the corresponding feature can still be recognized or realized as such. For example, "substantially from below and from the front" means that the airflow is directed toward the front of the intake housing. The front of the intake housing is defined in particular by the inlet opening. Such a directed air flow passes the inlet opening with a horizontal vector or a vector which has an angle to the horizontal and is directed upwards. The air flow directed in this way can also have a vector component coming from above, only this is smaller than a horizontal vector component and/or a vector component coming from below.

In one embodiment, at least one cover is provided associated with a top surface of the device and at least partially encloses the air inlet means, the at least one cover having the projection. In a further alternative embodiment, it is provided that the air intake means has a projection which is associated in particular with the top surface of the intake housing. This means in particular that the projection is arranged at least above the air intake means or the air intake opening.

It is further provided that the projection on the top surface and/or at least on the side of the device is extended away from the air inlet means or the air inlet opening, respectively. In particular, the projection extends both on the top surface and on the sides of the intake housing. Advantageously, the air flow can thus be directed. Preferably, the projection on the sides of the intake housing or the inlet opening has the advantage that it can be directed very precisely onto a vapor-forming container, such as a cooking pot, grill, wok or other cooking vessel. This optimizes the efficiency of vapor extraction in particular. In connection with the mobility as well as the alignability of the device, the inlet opening can be directed exactly to the cooking vessel that generates the vapors on the cooking facility.

In a further embodiment, it is provided that a protrusion of the projection over the air inlet means decreases from the top surface of the device towards the bottom surface of the device. In particular, an angled design is provided in which, further preferably, an extension of the projection on the top surface projects further away from the inlet opening than on the bottom surface. The extension away from the inlet opening is thus smaller at the bottom than at the top, whereby advantageously an inflow direction of the air flow into the device is induced or directed from obliquely below. In particular, it is advantageous to influence the inflow direction at least partially, since the device has a certain height, the inlet opening possibly being located above a cooking vessel. Cooking vapors can thus be drawn directly from the cooking vessel into the device by this directed air flow. In particular, the projection at the sides has an angle starting from a vertical of about 60° to about 85°, preferably about 80°. In one embodiment, no projection is provided below the inlet opening.

In a further embodiment, the lower wall has the outflow opening. In particular, the outflow opening is arranged in such a way that the air flow emerges from the air inlet means deflected by about 70° to about 120°, preferably about 80° to about 100°, more preferably about 90° with respect to the inflow direction. In a further embodiment, the outflow opening is arranged in such a way that the air flow cannot be deflected or can only be deflected by about 0° to about 90° to the inflow direction. In particular, in one embodiment it is provided that the outflow opening is arranged in a rear wall.

In one embodiment, the device comprises an adapter plate. In particular, the intake housing has the adapter plate. In a further embodiment, it is provided that the adapter plate is connectable to a pipe attachment which is aligned in particular with the outflow opening of the lower wall. In a further embodiment, the adapter plate has the pipe attachment. It is particularly preferred that the adapter plate can be arranged on the lower wall or, in particular, is made of the same material as the lower wall. In another embodiment, the adapter plate is provided by a housing encompassing the intake housing.

In a further embodiment, it is provided that the intake housing is adjustable in height. In particular, a distance between the intake housing and the blower housing is adjustable. In a further preferred embodiment, it is provided that the tube attachment can be inserted into the blower housing at a variable distance, so that the intake housing can be positioned at different heights relative to the blower housing. In a further embodiment, it is provided that the pipe attachment is telescopic so that the intake housing can be positioned at different heights relative to the blower housing.

In a further embodiment, the device has an inlet panel upstream of the inflow opening in the inflow direction. The inlet panel determines the width of the inflow opening, in particular if it is arranged immediately upstream of the inflow opening. Preferably, the inlet panel is configured vertically so that the surface of an opening in the inlet panel has a surface normal perpendicular to a vertical axis. In a further embodiment, the inlet panel is arranged at an angle to a vertical axis or the inlet opening, in particular adapted to an angle of the lateral projection, in front of the inlet opening. In one embodiment, the inlet panel can change the geometry of the inlet opening, in particular make it smaller, if this appears useful.

According to the invention, the device has the air inlet means. According to the invention, the inlet opening is formed by the upper wall and the lower wall. In one embodiment, the upper wall has an upper inflow edge and the lower wall has a lower inflow edge, each of which is preferably associated with the inlet opening. The upper inflow edge and/or the lower inflow edge preferably have a radius. In particular, the radius is about 5 mm to about 15 mm, preferably about 10 mm. Preferably, it is provided that the upper inflow edge and the lower inflow edge are adjacent to each other and thus define an inlet opening or an opening mouth. It is further preferred that the upper inflow edge extends at least partially downward and/or the lower inflow edge extends at least partially upward. Further preferably, at least one downwardly and/or upwardly extending section of the inflow edge also has the radius. Preferably, the inlet opening is substantially rectangular or substantially oval. In an embodiment of the upper and/or lower inflow edge having a radius, substantially a line, in particular a circumferential line, on the inflow edge, which has a tangent that is parallel with the vertical axis, defines the inlet opening. The upper inflow edge is preferably designed as a downwardly curved surface section. Further preferably, the lower inflow edge is designed as an upwardly curved surface section. Further preferably, the upper inflow edge and/or the lower inflow edge is arranged in such a way that a widening is formed in the region of the inlet opening.

In one embodiment, it is provided that the inflow edges extend at least partially into the interior of the air inlet means. Further preferably, the inflow edges form part of the corrugated shape.

In one embodiment, the intake housing has an air inlet means receptacle. Preferably, the air inlet means can be inserted into the air inlet means receptacle and can be locked in this receptacle, in particular releasably, by means of a latching element. To operate the latching element, the air inlet means receptacle and/or the intake housing has openings by means of which the air inlet means can be removed or unlatched from the air inlet means receptacle, for example for cleaning. In one embodiment, the openings are covered with flexible membranes that advantageously facilitate cleaning of the intake housing.

In one embodiment, the air inlet means further comprises a latching means, which is preferably designed as a latching receptacle. In particular, it is provided that the air inlet means has a top shell. It is further preferred that the upper shell has the latching means, in particular the latching receptacle. According to the invention, the air inlet means has at least the upper wall, which in one embodiment is at least partially embraced or surrounded by the upper shell.

Preferably, the latching element and the latching means form a snap connection. Further preferably, by means of the snap connection, the air inlet means can be connected in a releasable or non-releasable manner to the air inlet means receptacle in a form-fitting manner. In particular, the latching element has at least one latching lug that engages in the latching receptacle of the latching means. Further preferably, the latching element is deformed during insertion and snaps into the latching receptacle. Further preferably, the latching element and the latching means can be deformed to disengage the latching element and the latching means. In an alternative embodiment, the air inlet means comprises the latching element and the air inlet means receptacle comprises the latching means.

According to the invention, the corrugated shape of the upper wall has at least two upwardly curved surface sections, which can in particular be described as concave. Further preferably, the corrugated shape has at least two downwardly curved surface sections that can be described in particular as convex, with further preferably at least one convex surface section arranged between the upwardly curved ones. In one embodiment, the corrugation can be sinusoidal in section. In a further embodiment, the corrugation can have any desired shape, in particular continuous upward and downward curvatures. In particular, the widenings of the interior are arranged upward in the area of the curvatures of the upper wall and are further preferably formed by them. This has the advantage that the air flow within the air inlet means is applied at least to the upper wall, and further preferably also to the lower wall.

In one embodiment, it is provided that at least one concave surface section has a radius between about 25 mm and about 150 mm, preferably about 50 mm to about 100 mm, more preferably about 50 mm, more preferably about 100 mm. In a further embodiment, it is provided that the first concave surface section has a radius that is different from the radius of the second concave surface section. Further, in a preferred embodiment, it is provided that the radius of the first concave surface section is smaller than the second concave surface section. In particular, the first concave surface section has a radius of about 50 mm and the second surface section has a radius of about 100 mm. In a further embodiment, the radius of the first concave surface section is larger than the second concave surface section. In particular, the second concave surface section has a radius of about 50 mm and the first surface section has a radius of about 100 mm. Further, in a preferred embodiment, the radius of the first concave surface section is about the same as the second concave surface section. In particular, both concave surface sections have a radius of about 50 mm or about 100 mm.

The adjacent flow makes optimum use of the interior space of the air inlet means, in particular to the effect that energy losses can be avoided and thus energy can be saved or vapors can be extracted more efficiently. Furthermore, the widening caused by the corrugated shape also makes deflection of the air flow in the direction of the blower housing more energy-efficient.

Preferably, it is provided that a corrugation of at least the upper wall is designed such that a height of the interior space increases and decreases in the inflow direction. Preferably, it is provided that the interior space has at least a first widening and a second widening. In particular, the first widening is associated immediately or shortly after the inlet opening. Further preferably, the first widening is arranged downstream of the upper and/or lower inflow edge in the inflow direction and, further preferably, substantially immediately downstream thereof. In particular, the inflow edge is at least part of a downwardly curved surface section, which is followed by an upwardly curved surface section.

A further embodiment provides that a second widening is associated with an outflow opening. In particular, the second widening is arranged substantially above the outflow opening, that is, the corrugation is designed to be directed upwards above the outflow opening. In particular, the widening is defined at least above the outflow opening starting from a surface defining a wall of the outflow opening and a crest of the corrugated shape above the outflow opening.

The advantage of this embodiment is that the losses caused by the deflection of the air flow into the outlet opening are reduced by the widenings. Preferably, the corrugated shape or the widening of the housing, further preferably the multiple widening of the housing, lowers the losses during a subsequent deflection, in particular around the blower twisted by about 90°. Furthermore, the corrugated shape of at least the upper wall ensures better contact of the air flow with the upper wall and/or the lower wall, and thus preferably a lower-loss flow than with a straight design of the walls. Furthermore, vapors can advantageously be captured more widely in front of the inlet opening.

According to the invention, the corrugated shape causes at least two widenings of the interior space. In a further embodiment, it is provided that the corrugated shape causes 2, 3, 4 or more than 4 widenings of the interior space.

In a further embodiment, it is provided that the lower wall has at least partially a corrugated shape. In one embodiment, the lower wall has at least one, preferably at least two, more preferably at least three, downwardly curved surface sections that can also be described as concave. In one embodiment, the lower wall has at least one, preferably at least two, more preferably at least three, upwardly curved surface sections that can also be described as convex. In particular, the corrugation of the lower wall at least partially increases the widening of the interior by the corrugation of the upper wall or at least causes widening at other locations. In particular, it is provided that the upper wall and the lower wall have at least partially antiparallel corrugations. In particular, this means that a corrugation sweep of the upper wall upward is substantially parallel to a corrugation sweep of the lower wall downward. In one embodiment, antiparallel corrugation may also be understood to mean that an upward corrugation sweep of the upper wall is substantially parallel to a downward corrugation sweep of the lower wall, wherein the geometric designs of the corrugation sweeps and/or the amplitude of the corrugation sweeps differ from one another.

In particular, a corrugation is to be understood as the shape of a transverse wave in the inflow direction. It is further preferred that the interior space is widened and narrowed by the corrugation in the inflow direction. In particular, the interior space is alternately widened and narrowed by the corrugation of at least the upper wall.

In particular, the design of the second widening, which is assigned in particular to the outflow opening, improves an incident flow from upper areas above a hob or can increase the coverage area. In an embodiment with a projection, it is further provided that the incident flow at the projection is optimized.

In an exemplary embodiment, it is provided that a first widening in the inflow direction is provided upstream of the lower and upper inflow edges in the region of the inlet opening. A narrowing by the downwardly curved inflow edge, which in particular forms the first downwardly curved surface section, is followed in the direction of flow by a second widening by at least a first upwardly curved surface section of the upper wall. In particular, the upper wall has a second downwardly curved surface section that joins the first upwardly curved surface section and that provides a second narrowing of the interior space. Further preferably, the upper wall has a second upwardly curved surface section which joins the second downwardly curved surface section and which causes a third widening of the interior space. Further preferably, the upper wall extends into the closed rear wall in the inflow direction after the third widening.

In a further embodiment, it is provided that the air inlet means has a vertical opening angle. In particular, a first side of the vertical opening angle is tangent to at least two convex surface sections and a second side is arranged horizontally. Preferably, the vertical opening angle is about 1° to about 5°, more preferably about 2° to about 4°, more preferably about 2°, more preferably about 4°. Preferably, the vertical opening angle opens upward. In particular, in one embodiment, a vertex of the first convex surface section is disposed higher than a vertex of the second convex surface section.

According to the invention, it is provided that the air inlet means has said horizontal opening angle, wherein the horizontal opening angle is an angle in a horizontal sectional view of said air inlet means, the sides of which are applied to the lateral inner walls. In one embodiment, the horizontal opening angle is about 30° to about 60°, preferably about 40° to about 55°, more preferably about 45° to about 50°, more preferably about 46° and about 50°, more preferably about 48°. The horizontal opening angle is advantageously optimally designed for a mobile use of the device. The horizontal opening angle allows good directability of the air flow to be sucked in, high energy efficiency and high volume flow, so that the device is especially designed for placement next to a cooking facility.

It is further preferred that the upper wall and the lower wall form a closed rear wall opposite the inlet opening in the inflow direction. It is further preferred that a narrowing of the interior of the air inlet means is effected by upper and/or lower walls, preferably directly in front of the closed rear wall. In one embodiment, the closed rear wall is a surface section formed by the upper wall and the lower wall. Preferably, the closed rear wall has a rearwardly curved surface section. Further preferably, by means of the closed rear wall, the air flow can be guided to the outflow opening.

In an embodiment in which the corrugated shape is provided in conjunction with the projection, there is the advantage of both direction of airflow and optimization and energy efficiency in the extraction of vapors.

Due to the expansion of the interior space generated by the widenings, the effective flow cross-section within the air inlet medium increases. This achieves a levelling of the flow within the air inlet medium. In particular, this effect is enhanced by the alternation of widening and narrowing. This results in a homogeneous and thus more favorable velocity distribution in the region of the inlet opening and, in one embodiment, in the region of the projection, if any, and, in one embodiment, in the region of the outlet opening of the intake housing, thus reducing the overall pressure drop.

In another embodiment, the intake housing is provided with a bottom shell that at least partially encloses the lower wall. In a further embodiment, the bottom shell and the top shell may together form a housing that at least partially, preferably completely, enclose the air inlet means. It is particularly preferred that the bottom shell has an outflow opening which is preferably aligned with the outflow opening of the lower wall.

According to the invention, the device has a blower housing. In one embodiment, it is provided that the intake housing is detachably connected to the blower housing. In particular, detachably connected means that the intake housing can be separated from the blower housing without tools. In a further embodiment, it is provided that the intake housing is not detachably connected to the blower housing without tools. Preferably, it is provided that the blower housing comprises a blower. In particular, the blower is designed as an axial blower, radial blower or cross-flow blower, with a design as a radial blower being preferred. It is further advantageous that the intake housing is detachably connected to the blower housing via the adapter plate. In a further embodiment, it is provided that the intake housing is rotatably connected to the blower housing. In a further embodiment, the intake housing is tiltably connected to the blower housing. In particular, the intake housing can be tilted upward and/or downward relative to the blower housing. Advantageously, such an alignment can be directed, for example, towards a vapor-generating cooking vessel.

The rotatable connection between the inlet housing and the blower housing has the advantage that the inlet opening can be easily aligned, whereby the inlet housing, which is preferably lighter than the blower housing, can be rotated without having to rotate the complete device for this purpose.

In a further embodiment, the blower housing has an air inlet opening. This is preferably arranged on the top of the blower housing. In one embodiment, it is provided that the air inlet opening preferably receives a pipe attachment at least partially. In one embodiment, the pipe attachment can be part of the adapter plate. In a further embodiment, it is provided that the pipe attachment is part of the air inlet opening or arranged in the air inlet opening. It is also provided that the adapter plate can be placed on the pipe attachment. The adapter plate or blower housing and intake housing can be connected via the pipe attachment.

In a further embodiment, it is provided that the blower housing comprises at least one safety switch. Preferably, it is provided that the safety switch is a proximity sensor, an induction sensor, a pushbutton, a contact closure obtainable, for example, via the pipe attachment, or some other switching or sensing device. In particular, it is provided that the blower housing has the blower that can be switched by means of the safety switch. The advantage of the provision of at least one safety switch is that the blower stops or is switched off as soon as the intake housing is removed from the blower housing. In particular, in one embodiment it is provided that the safety switch is arranged in the area of the intake opening. In a further embodiment, it is provided that the safety switch is arranged on the top side of the blower housing or is assigned to the top side. In a further embodiment, it is provided that the safety switch can be switched by means of the intake housing and/or the pipe attachment.

In a further embodiment, the blower housing has air outlet openings. The blower housing has at least one air outlet opening. Preferably, the housing has at least two air outlet openings. Further preferably, it is provided that the air outlet openings are arranged at the sides, the rear and/or the front. Preferably, the air outlet openings are arranged on the sides of the blower housing. In a further embodiment, it is provided that filters are associated with the air outlet opening to filter the air flow.

The air flow is induced by the blower located in the blower housing. The blower draws in air, which is fed through the inlet opening into the interior of the intake housing. If a projection is present, the air is directed and, if necessary, calmed before flowing into the interior. In the interior space, if the upper and/or lower walls have a corrugated shape with at least two curvatures, each of which widens the interior space, the airflow is applied to the upper and/or lower walls. Inside the interior, the airflow is deflected towards the blower housing, which is in particular about 90° downwards. The air flow enters the blower housing through the outflow opening in the lower wall. In particular, the air flow is directed into the blower housing through a pipe attachment arranged on the adapter plate, which is at least partially inserted into the intake opening. The air flow passes through the blower and preferably filters arranged downstream of it. Then the air flow exits through the air outlet openings on the blower housing.

In a further embodiment, it is provided that the blower housing has an electrical unit. The electrical unit is preferably arranged at the rear of the blower housing. In a further embodiment, the electrical unit is arranged in the blower housing. In particular, the electrical unit comprises the electrical supply, a control system and/or a regulation system for the blower.

In a first exemplary embodiment, it is provided that the inlet opening is associated with a projection, which is formed by the covers, for example. In particular, the projection protrudes above the inlet opening. Furthermore, it can be seen that the projection extends further above the inlet opening than below the inlet opening. For example, no projection is provided below the inlet opening. The cover thus forms the projection enclosing the inlet opening at an angle to the horizontal. In the first exemplary embodiment, it is provided that the upper or lower wall does not have a corrugated shape.

In a second exemplary embodiment, it is provided that at least the upper wall has a corrugated shape. The waveform exemplarily forms a first widening and a second widening within the air inlet means. Preferably, the first widening is associated with the air inlet opening and widens the air inlet means immediately behind the radiused inflow edges. An exemplary air flow enters the air inlet means through the inlet opening in the inflow direction and is applied by the corrugation at least to the upper wall. Further, the airflow is directed away downwardly rearwardly through the outflow opening. In the second exemplary embodiment, it is further provided that the lower wall has a shaping that reinforces the widening of the interior space. In particular, a recess is provided behind the lower inflow edge to help shape the widening. The lower wall forms an upwardly extending bead around the outflow opening and extends downwardly within the bead to the outflow opening. In the second exemplary embodiment, it is provided that the device has no projection.

In a third exemplary embodiment, it is provided that at least the upper wall has a corrugated shape. The corrugation exemplarily forms a first widening and a second widening within the air inlet means. Preferably, the first widening is associated with the air inlet opening and widens the air inlet means immediately behind the radiused inflow edges. An exemplary air flow enters the air inlet means through the inlet opening in the inflow direction and is applied by the corrugation at least to the upper wall. Further, the airflow is then directed away downwardly rearwardly through the outflow opening. In the third exemplary embodiment, it is further provided that the lower wall has a shaping that increases the widening of the interior. In particular, a recess is provided behind the lower inflow edge to help shape the widening. The lower wall forms an upwardly extending bead around the discharge opening and extends downward within the bead to the outflow opening. In the third exemplary embodiment, it is further provided that the inlet opening is associated with a projection formed, for example, by the covers. In particular, the projection protrudes above the inlet opening. Furthermore, it can be seen that the projection extends further above the inlet opening than below the inlet opening. For example, no projection is provided below the inlet opening. The cover thus forms the projection enclosing the inlet opening at an angle to the horizontal.

Common to all exemplary embodiments is that the device is designed with an intake housing and a blower housing. The intake housing comprises an air inlet means. The device has a top surface and a bottom surface. Further, the device includes two sides and a front and a rear. Air outlet openings are provided on the sides of the blower housing. The intake housing has an air inlet means. The air inlet means has an upper wall with an inflow edge. A lower wall is connected to the upper wall and forms with the latter an interior space not further described here. The lower inlet edge of the lower wall adjoins the upper inlet edge of the upper wall and forms a rounded rectangular inlet opening with the latter. Furthermore, the lower wall has an outflow opening through which an air stream can be guided into an air inlet opening of the blower housing. A top shell and a bottom shell enclose the air inlet means. The bottom shell has an outflow opening which is aligned with the outflow opening of the lower wall and through which the air flow can be guided in the direction of the blower housing.

In all exemplary embodiments, the intake housing preferably further comprises two covers arranged one above the other as well as an air inlet means receptacle which enclose and protect the air inlet means. Preferably, the exemplary embodiment provides that at least one operating element is integrated into the intake housing, wherein at least one cover has an opening through which the at least one operating element can be operated. The air inlet means receptacle has at least one latching element which cooperates with at least one latching receptacle of the top shell. In this way, the air inlet means can be detachably inserted into the intake housing together with the top and bottom shells. In particular, the detachability of the air inlet means facilitates cleaning thereof.

An adapter plate is arranged below the air inlet means receptacle as well as the cover. In the exemplary embodiments, a pipe attachment is preferably arranged below the adapter plate. The pipe attachment is preferably designed in alignment with the outflow opening of the lower wall when the air inlet means is inserted into the air inlet means receptacle. An inlet panel is placed or arranged in front of the air inlet means to further define the air inlet opening, in particular by shaping an inlet panel opening.

In the exemplary embodiments, the air inlet means has an upper wall and a lower wall. The upper wall has a corrugated shape on the inside. Furthermore, the lower wall has an outflow opening which is aligned with the pipe attachment. The upper wall and the lower wall also have inflow edges which define the inflow opening. The pipe attachment is preferably part of the adapter plate and is fixed therein. In a further embodiment, the pipe attachment can be removed from the adapter plate. The inflow edges each have a radius and are preferably not sharp. The pipe attachment of the intake housing can be inserted into the air inlet opening, whereby at least one safety switch is actuated by putting the two housing parts together. The at least one safety switch is preferably arranged in a wall section forming the air inlet opening. Furthermore, the blower and the electrical unit are arranged in the blower housing.

In particular, the intake housing comprises said air inlet means, wherein the air inlet means has an upper wall and a lower wall which form an interior with an inlet opening, wherein at least the upper wall has a corrugated shape on an inner side with at least two upwardly curved surface sections, wherein at least in the region of the upwardly curved surface sections the interior has widenings, and the inlet opening is associated with a projection.

Furthermore, a method is proposed for extracting vapors above the cooking hob by means of the device described above, wherein an air flow is generated by means of a blower into an intake housing with an air inlet means wherein the air inlet means has a horizontal opening angle, at least by means of an upper wall of the air inlet means, which has a corrugated shape at least on an inner side, the air flow is applied to at least the upper wall, the air flow is directed into a blower housing at least via an outflow opening in a lower wall of the air inlet means.

Alternatively or additionally, a method is proposed for extracting vapors above a cooking hob by means of the device described above, wherein an air flow is generated by means of a blower into an intake housing with an air inlet means, the air flow from an air inlet means is calmed and/or directed by means of a projection extending in particular over an inlet opening of the intake housing, the air flow is drawn into the intake housing through the inlet opening, and the air flow is directed into a blower housing at least via an outflow opening in a lower wall of the air inlet means.

In one embodiment, the method provides that both by means of a projection extending in particular at an inlet opening of the intake housing, the air flow in front of an air inlet means is calmed and/or directed, and at least by means of an upper wall of the air inlet means, which has a corrugated shape at least on an inner side, the air flow is at least partially applied to at least the upper wall.

Furthermore, the use of a device described above for the extraction of vapors above a hob is proposed.

FIG. 1 shows a device 10 having an intake housing 78 and a blower housing 20. The intake housing 78 includes an air inlet means 40. The device 10 has a top surface 16 and a bottom surface 17. Further, the device includes two sides 12 and 13 and a front 14 and a rear 15. Air outlet openings 24 are provided on the sides 12 and 13 of the blower housing 20.

The intake housing 78 further comprises at least one cover 82 in the embodiment shown here. The air inlet means 40 and/or an air inlet means receptacle, which is not visible here and which preferably at least partially encloses the air inlet means 40, has a latching element 84 which interacts with a latching receptacle 44 of the cover 82. In this manner, the air inlet means 40 can be detachably inserted into the intake housing 78. In particular, the detachability of the air inlet means 40 facilitates cleaning thereof.

Figure 2:
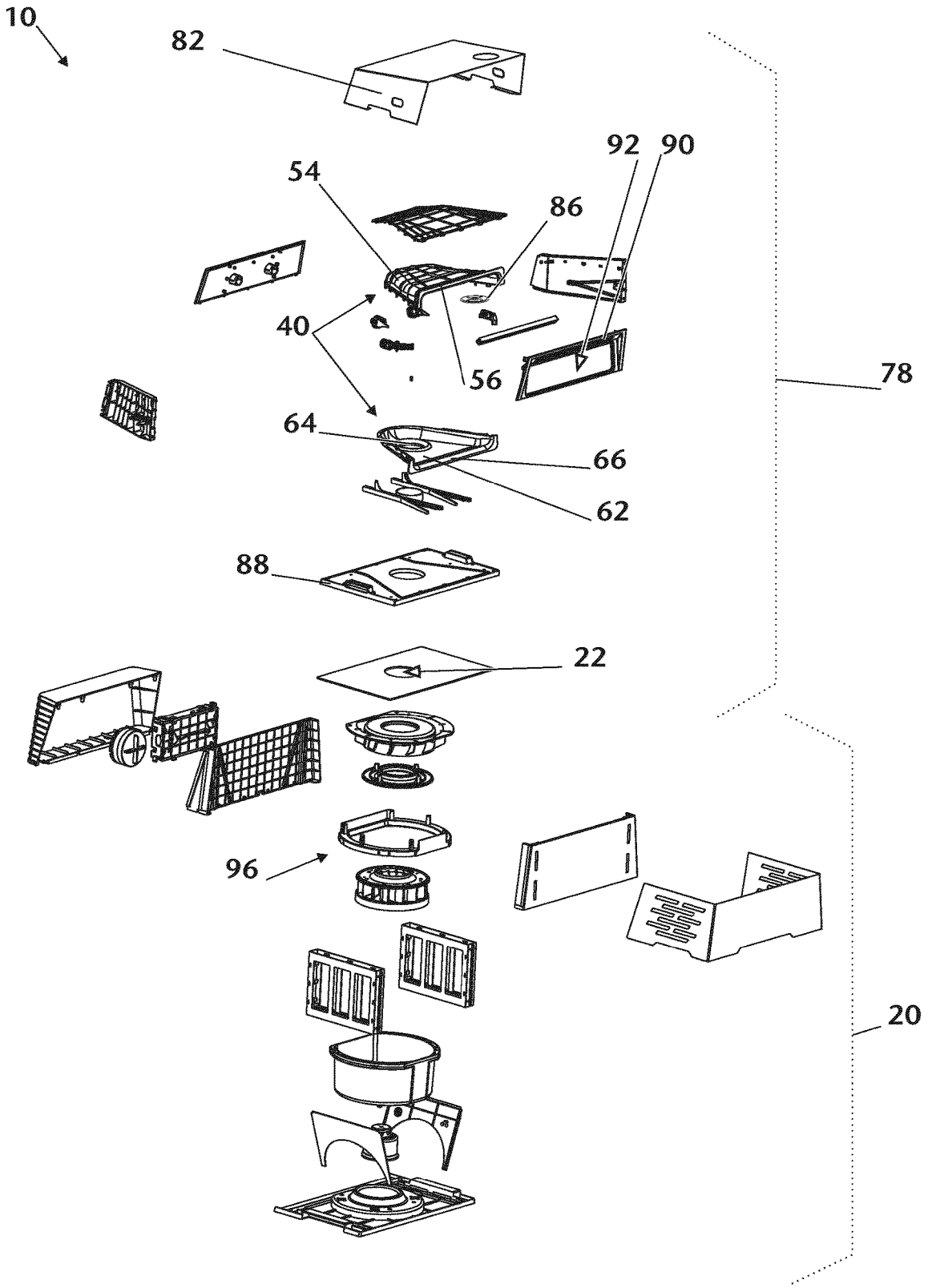
FIG. 2 an exploded view of an alternative device.

FIG. 2 shows an exploded view of a further embodiment of the device 10, with particular reference being made below to the individual parts of the intake housing 78. The intake housing 78 has an air inlet means 40. The air inlet means 40 has an upper wall 54 with an inflow edge 56. A lower wall 62 is connected to and forms with the upper wall 54 an interior space not further described herein. The lower inlet edge 66 of the lower wall 62 is adjacent to the upper inlet edge 56 of the upper wall 54 and forms with the latter a rounded rectangular inlet opening 72, which can be seen in FIG. 3. Further, the lower wall 62 has an outflow opening 64 through which an airflow 18 shown in FIG. 4 can be directed into an air inlet opening 22 of the blower housing 20.

In the embodiment shown here, the intake housing 78 further comprises a cover 82. Preferably, in the embodiment shown here, it is provided that an operating element 86 is integrated into the intake housing 78, wherein the cover 82 has an opening, not further specified here, through which the operating element 86 can be operated.

An adapter plate 88 is arranged below the air inlet means receptacle 80 and the cover 82. An inlet panel 90 is placed in front of the air inlet means 40 or arranged in front of it in order to further define the inlet opening 72, which can be taken from FIG. 3, in particular by shaping an inlet panel opening 92. Also in another embodiment, it is provided that the inlet panel 90 only frames the air inlet means 40 or the inlet panel 90 is completely omitted.

Figure 3:
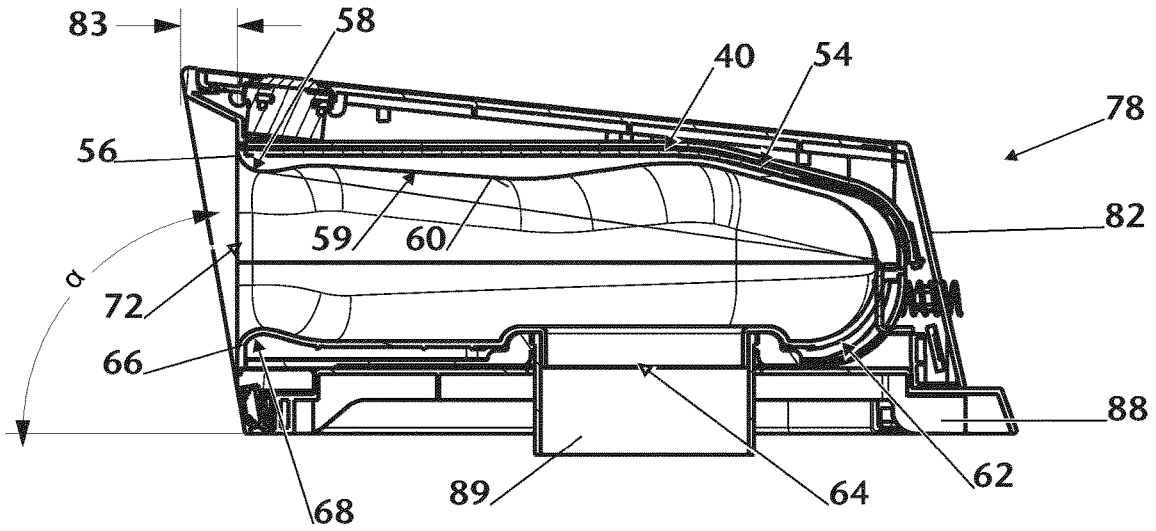
FIG. 3 a sectional view of the device of FIG. 1, with an intake housing separated from a blower housing.
Figure 3:
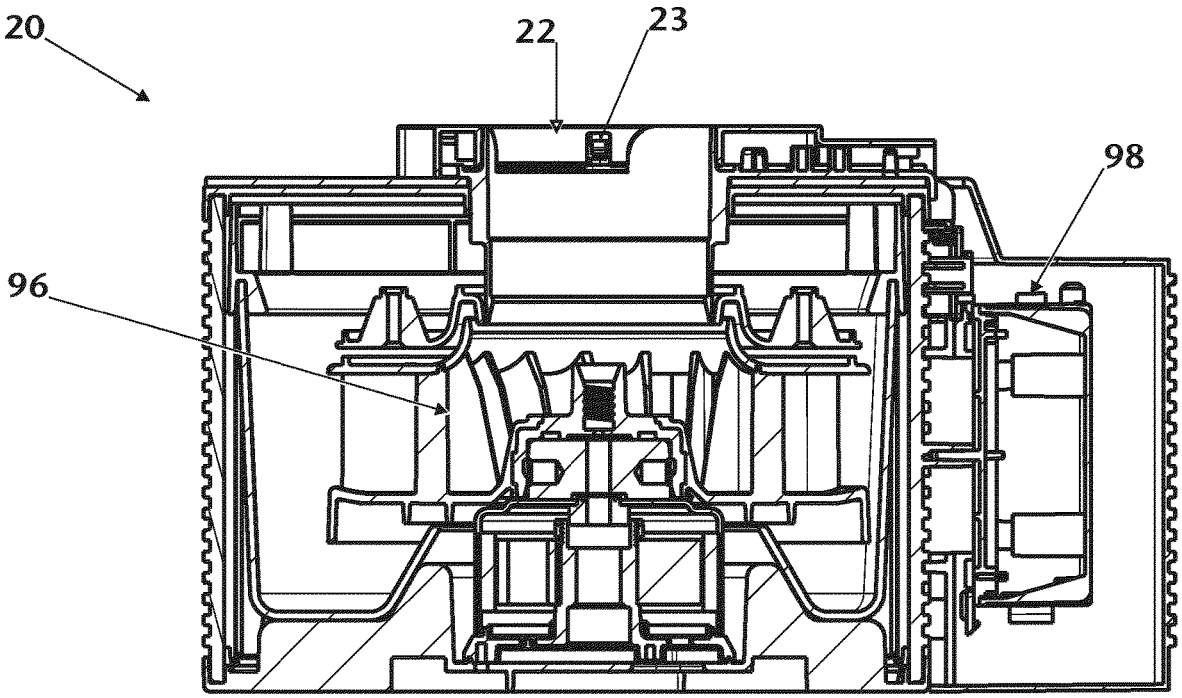

FIG. 3 shows a longitudinal section through the device 10 of FIG. 1, wherein the intake housing 78 is separated from the blower housing 20. It can be seen that the inlet opening 72 is associated with a projection 83, which in the embodiment shown is formed by the covers 82. In particular, the projection 83 protrudes above the inlet opening 72 by about 23 mm. Furthermore, it can be seen that the projection 83 extends further above the inlet opening 72 than below the inlet opening 72. In particular, it is provided that no projection 83 is provided below the inlet opening 72. The cover 82 thus forms a projection 83 surrounding the inlet opening 72 with an angle $\alpha$ to the horizontal of about 80°.

As described in the general description, the device 10 may also be designed without a projection 83.

The air inlet means 40 has an upper wall 54 and a lower wall 62. The upper wall 54 has a corrugated shape 59 on the inner side 60. Furthermore, the lower wall 62 has an outflow opening 64 which is aligned with the pipe attachment 89. The upper wall 54 and the lower wall 62 also have inflow edges 56 and 58 that define the inflow opening 72. As can further be seen from FIG. 3, the pipe attachment 89 is part of the adapter plate 88 and is fixed therein. In a further embodiment, the pipe attachment 89 can be removed from the adapter plate 88. The inlet edges 56 and 66 each have a radius 58 and 68 and are preferably not sharp.

Furthermore, in FIG. 3, the blower housing 20 can be seen in a sectional view, where it can be seen that the pipe attachment 89 of the intake housing 78 can be inserted into the air inlet opening 22, whereby a safety switch 23 is actuated by inserting the two housing parts 78 and 20 together. The safety switch 23 is preferably arranged in an undescribed wall section forming the air inlet opening 22. Furthermore, the blower 96 and the electrical unit 98 are arranged in the blower housing 20.

Figure 4:
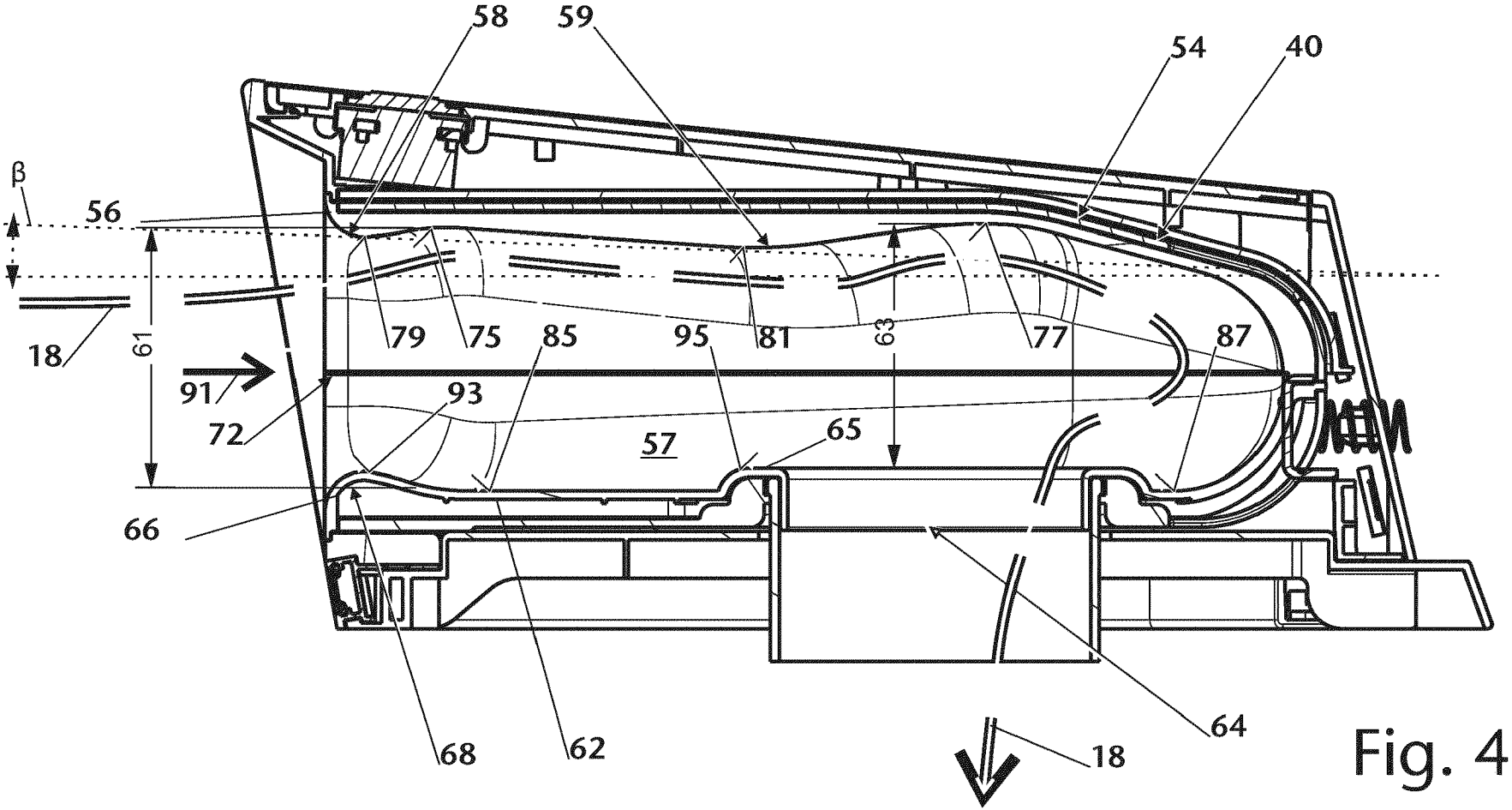
FIG. 4 a detailed view of the section shown in FIG. 3.

FIG. 4 shows a sectional view of the intake housing 78 according to FIG. 1, in which it can be seen that the corrugated shape 59 of the upper wall 54 has at least two upwardly curved surface sections 75 and 77, which can in particular be described as concave. Further preferably, the corrugated shape 59 has at least two downwardly curved surface sections 79 and 81, which can be described in particular as convex. The upwardly curved surface sections 75 and 77 result in a first widening 61 and a second widening 63 in the interior 57 of the air inlet means 40. Preferably, the first widening 61 is associated with the air inlet opening 72 and widens the air inlet means 40 immediately behind the inflow edges 56 and 66 provided with radii 58 and 68.

An opening angle $\beta$, the upper side of which is tangent to the vertices of the downwardly curved surface sections 79 and 81 and the lower side of which is horizontal or in the inflow direction 91, is about 2°.

FIG. 4 also shows an exemplary air stream 18 which flows into the air inlet means 40 through the inlet opening 72 in the inflow direction 91 and is applied to at least the upper wall by the corrugated shape 59. Furthermore, it can be seen that the air flow 18 is then guided away downwards and backwards through the outflow opening 64.

FIG. 4 also shows that the lower wall 62 has a shaping that reinforces the widening 61 and 63 of the interior 57. Thus, the lower wall 62 has two downwardly curved surface sections 85 and 87, which can also be described as concave. Further, the lower wall 62 has two upwardly curved surface sections 93 and 95, which can also be described as convex. The inflow edges 56 and 66 are formed by the convex surface sections 79 and 93. This shaping forms an opening mouth that opens outwardly. In particular, the downwardly curved surface section 85 is provided behind the lower inflow edge 66 which contributes to forming the widening 61. The lower wall 62 forms an upwardly extending bead 65 around the outflow opening 64, which is formed by the upwardly curved surface section 95, and extends downwardly within the bead 65 to the outflow opening 64.

In an embodiment not shown here, either only the corrugation 59 of the air inlet means 40 is designed without the projection 83, which can be seen in FIG. 3. And in a further embodiment, it is provided that the device is only designed with a projection 83 without the corrugation 59 in the air inlet means 40.

Figure 5:
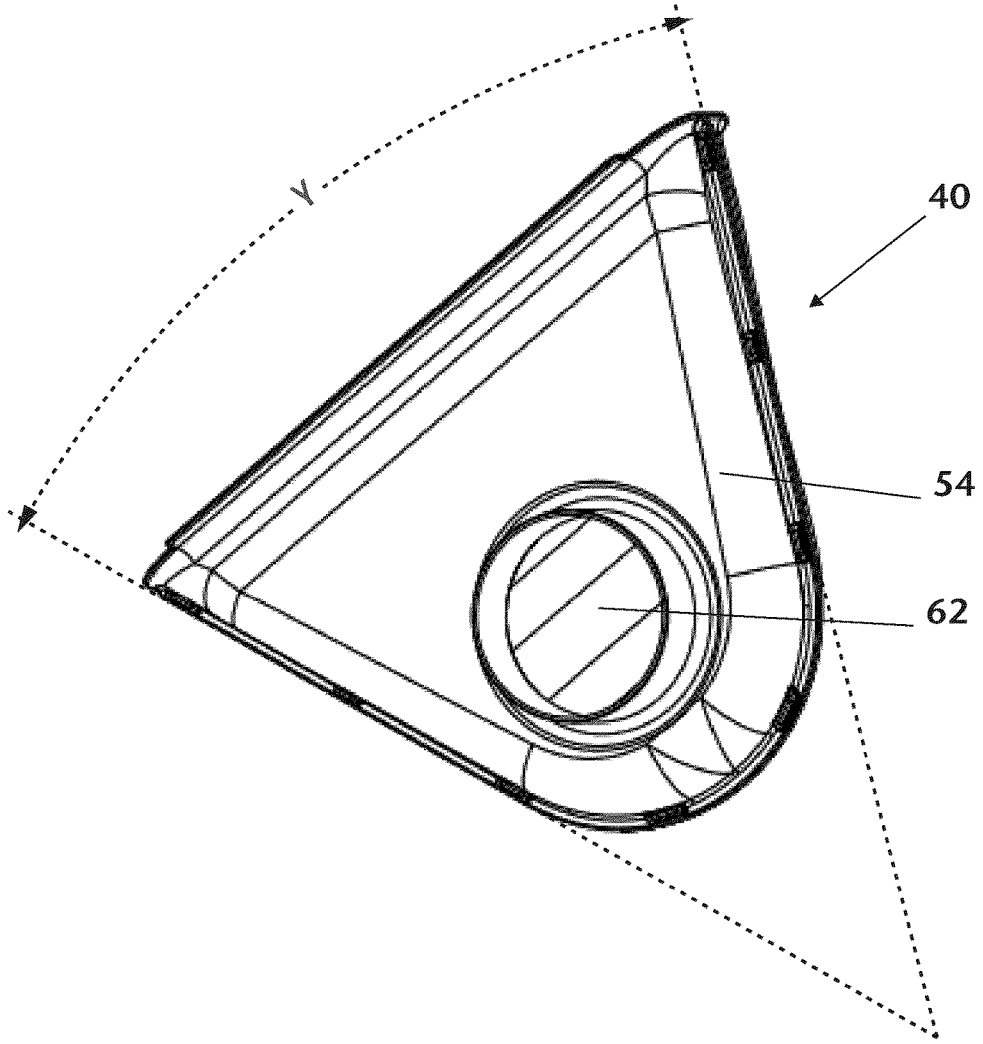
FIG. 5 a view of the air inlet means from below.

FIG. 5 shows a bottom view of the air inlet means according to FIG. 1. A horizontal opening angle γ has sides applied to the lateral inner walls formed by the upper wall 54 and/or by the lower wall 62. The angle has about 48° and is thus optimally designed for a mobile application of the device 10.

Figure 6:
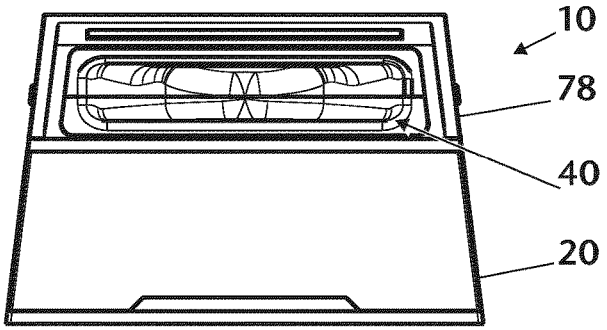
FIG. 6 a front view of the device according to FIG. 2.

FIG. 6 shows a front view of the device 10 in the alternative embodiment according to FIG. 2. The intake housing 78 with the air inlet means 40 as well as the blower housing 20, which is arranged below the intake housing 78, can be seen.

Figure 7:
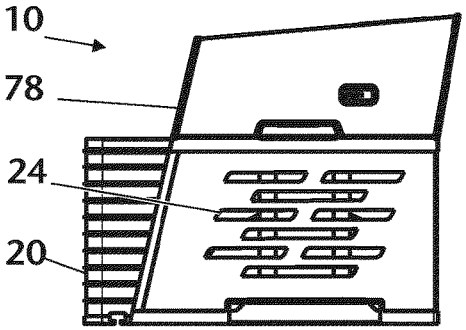
FIG. 7 a side view of the device according to FIG. 6.

FIG. 7 shows a side view of the device 10 in the embodiment according to FIG. 2. There, the intake housing 78 and the blower housing 20 can be seen. The air outlet openings 24 are configured as a number of horizontal slots.

Figure 8:
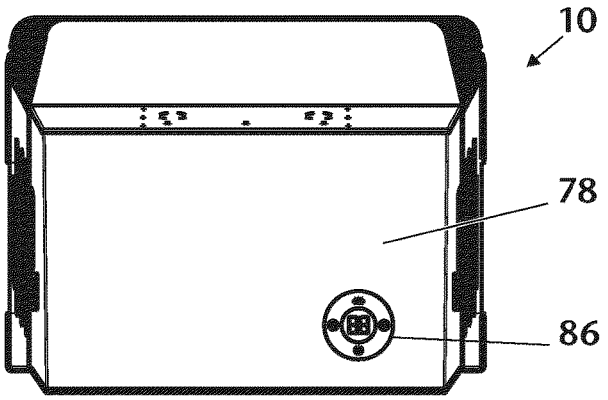
FIG. 8 a top view of the device according to FIG. 6.

FIG. 8 shows the device 10 in the configuration according to FIG. 2 in a top view. There, the intake housing 78 with the operating unit 86 can be seen.

The described device 10 can draw in or extract vapors in a very energy-efficient and directed manner, whereby it can be designed to be mobile in particular, so that it can be used for many purposes in kitchens or at cooking sites outside buildings.

The invention claimed is:

1. A device for extracting vapors comprising:

an intake housing and a blower, wherein the intake housing includes an upper wall and a lower wall that when coupled together define an interior space with an inlet opening and an air inlet, the air inlet has a horizontal opening angle, wherein the horizontal opening angle (γ) is an angle in a horizontal sectional view of the air inlet whose sides are applied to lateral inner walls, wherein the lower wall having on an inner side a planar surface, wherein the upper wall has on an inner side a corrugated shape with at least two upwardly curved surface sections each having different radiuses, wherein at least in the region of the upwardly curved surface sections the interior space has widenings in a direction of airflow defined by the at least two upwardly curved surface sections, a height of the interior space between the at least two upwardly curved surface sections and the planar surface on the inner side of the lower wall increases and decreases in the inflow direction based on the different radiuses of the at least two upwardly curved surface sections.

2. The device according to claim 1, wherein a first widening is associated with the inlet opening.

3. The device according to claim 1 wherein a second widening is associated with an outflow opening.

4. The device according to claim 1 wherein a projection is associated with the inlet opening.

5. The device according to claim 4, wherein at least one cover is associated with a top surface of said device and at least partially envelops said air inlet, said at least one cover forming said projection.

6. The device according to claim 5 wherein the projection on the top surface and/or on at least one side of the device is extended away from the air inlet.

7. The device according to claim 4 wherein a protrusion of the projection over the air inlet decreases from a top surface of the device towards a bottom surface of the device.

8. The device according to claim 1 wherein the intake housing is detachably connected to a blower housing.

9. The device according to claim 8, wherein the intake housing is rotatably connected to the blower housing.

10. The device according to claim 8 wherein the blower housing comprises the blower, which is switchable by a safety switch.

11. The device according to claim 8 wherein the intake housing and the blower housing are movable together and/or separately from each other.

12. The device according to claim 1, wherein the interior space has at least a first widening and a second widening, wherein the first widening is associated immediately or shortly after the inlet opening and the second widening is arranged substantially above an outflow opening.

13. A method for extracting vapors above a cooking hob comprising the steps of:

generating an air flow by a blower into an intake housing, the intake housing includes an upper wall and a lower wall that when coupled together define an interior space with an inlet opening and an air inlet, wherein the air inlet has a horizontal opening angle, at least by the upper wall of the air inlet, which has at least on an inner side a corrugated shape with at least two upwardly curved surface sections each having different radiuses, the lower wall having on an inner side a planar surface, the air flow is at least partially applied to at least the upper wall, wherein at least in the region of the upwardly curved surface sections the interior space has widenings in a direction of airflow defined by the at least two upwardly curved surface sections, a height of the interior space between the at least two upwardly curved surface sections and the planar surface on the inner side of the lower wall increases and decreases in the inflow direction based on the different radiuses of the at least two upwardly curved surface sections; and directing the air flow into the blower at least via an outlet opening of the air inlet.

14. The method of claim 13, wherein the interior space has at least a first widening and a second widening, wherein the first widening is associated immediately or shortly after the inlet opening and the second widening is arranged substantially above an outflow opening.

* * * * *